United States Patent [19]

Pilchard

[11] 3,993,205

[45] Nov. 23, 1976

[54] PRE-TIED NECKTIE HANGER

[76] Inventor: Charles C. Pilchard, 225 S. Stine Road, Bakersfield, Calif. 93309

[22] Filed: Feb. 21, 1975

[21] Appl. No.: 551,729

[52] U.S. Cl. ..... 211/116; 211/119; 223/DIG. 1; 223/88

[51] Int. Cl.[2] ..... A47F 7/12

[58] Field of Search ..... 223/85, DIG. 1, 88, 223/92, 95; 211/113, 116, 119, 100

[56] References Cited

UNITED STATES PATENTS

| | | | |
|---|---|---|---|
| 381,888 | 4/1888 | Rice | 223/88 |
| 2,058,217 | 10/1936 | Dixon | 211/119 |
| 2,205,489 | 6/1940 | Nelson | 223/95 |
| 2,460,438 | 2/1949 | Treiman | 223/92 |
| 2,644,589 | 7/1953 | Levine | 211/119 X |
| 3,194,457 | 7/1965 | Freilich | 223/88 |
| 3,452,881 | 7/1969 | Jamison | 223/85 X |
| 3,642,143 | 2/1972 | Cass | 211/13 |
| 3,705,653 | 12/1972 | Pereyra | 211/13 |
| D206,638 | 1/1967 | Van Dusen | 223/DIG. 1 |

*Primary Examiner*—George H. Krizmanich
*Attorney, Agent, or Firm*—Victor J. Evans & Co.

[57] ABSTRACT

A necktie hanger for holding a plurality of pre-tied neckties such as would be used to store them in a closet or hold them on display for sale. A top half loop is provided for attaching the hanger to some form of support while positioned horizontally across the bottom of the hanger there are a plurality of loops for holding the ties. The narrow part of the loops are spaced together close enough to hold the knot of a pre-tied necktie and deep enough to act as a slot for holding the same. The holder portion of the hanger as well as the structure of the slots may be either in two parts or in one separate structure.

3 Claims, 3 Drawing Figures

PRE-TIED NECKTIE HANGER

BACKGROUND OF THE INVENTION

1. Field of the Invention

The present invention relates to necktie hangers.

2. Summary of the Invention

The present invention of a necktie hanger suspended from the rigid support and extending parallel therewith there is a wire member providing a plurality of tapering slots. The narrow most part of the slots being at the bottom of the wire member and being sufficiently spaced so as to support a pre-tied necktie knot so that the tie hangs in a vertical position in the slot. Furthermore, the slots while being relatively close together are still sufficiently spaced apart so that a plurality of ties may hang in parallel relationship without overlapping.

The primary object of the invention is to provide a pre-tied necktie hanger of sufficient strength to support a plurality of ties while at the same time presenting them in a neat arrangement for display.

Other objects and advantages will become apparent in the following specification when considered in light of the attached drawings.

DESCRIPTION OF THE PREFERRED EMBODIMENTS

Figure 1:
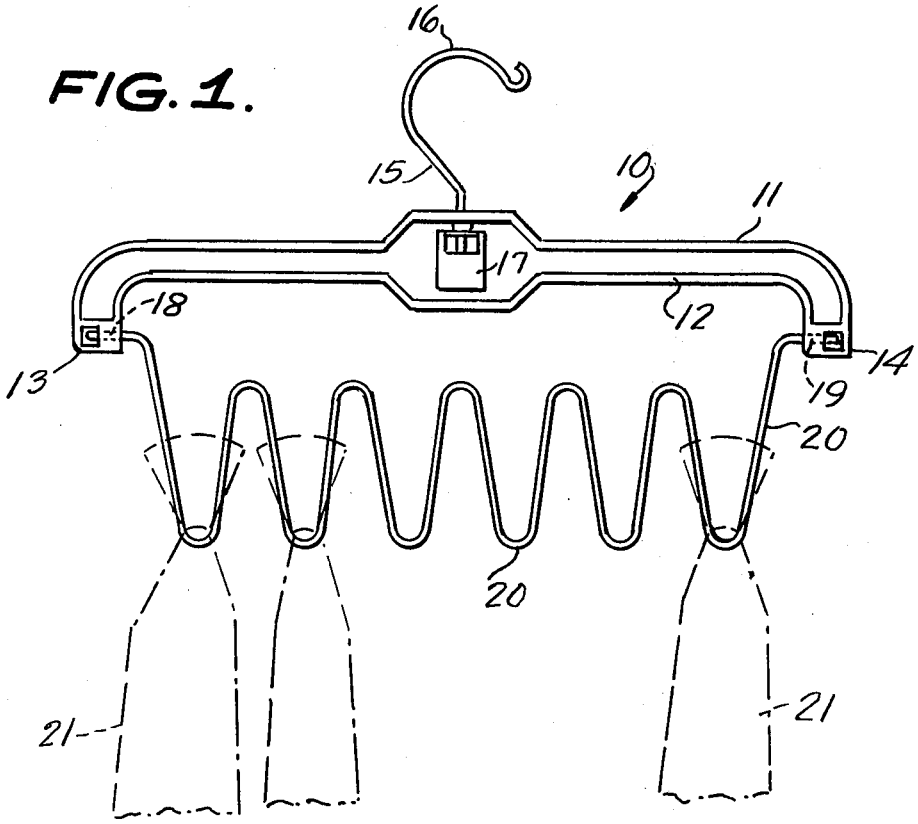
FIG. 1 shows an elevational view of one modified form of the invention.
Figure 2:
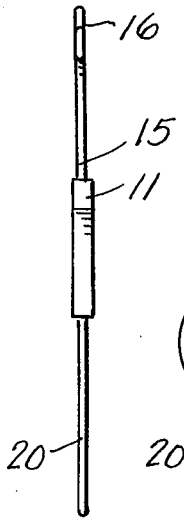
FIG. 2 is a side elevation of the invention as shown in FIG. 1.

Referring now to the drawings in detail, wherein like reference characters indicate like parts throughout the several figures, the reference numeral 10 indicates generally a rigid hanger somewhat in the category of a coat hanger. Hanger 10 consists of two rigid metallic bars 11 and 12 spaced essentially parallel to one another and joined at their ends by blocks 13 and 14.

Midway along the length of rigid support 11 and 12, and extending at right angles to their length, there is a mounting member 15 the outer end of which is curved into a semi-circular configuration 16 for positioning on a closet pole or other means of support.

The inner end of mounting support 15 passes through a rotatable mounting 17, mounting 17 being placed between the supporting members 11 and 12.

Extending parallel across the distance of support members 11 and 12 and in a vertically hanging position there is a heavy gauge wire convolution 20, the ends of wire convolution 20 being inserted into the holes 18 and 19 in the end block 13 and 14 respectively. The convolution member 20 provides a plurality of vertically extending narrowly tapering slots, the lowest portions of the convolutions and therefore the narrow walls of the slot being sufficiently close together to hold the knot of a pre-tied necktie 21. Therefore, by the configuration of the convolutions the present invention offers a means for either storing or displaying a plurality of pre-tied neckties which are not overlapping or hidden from view.

Figure 3:
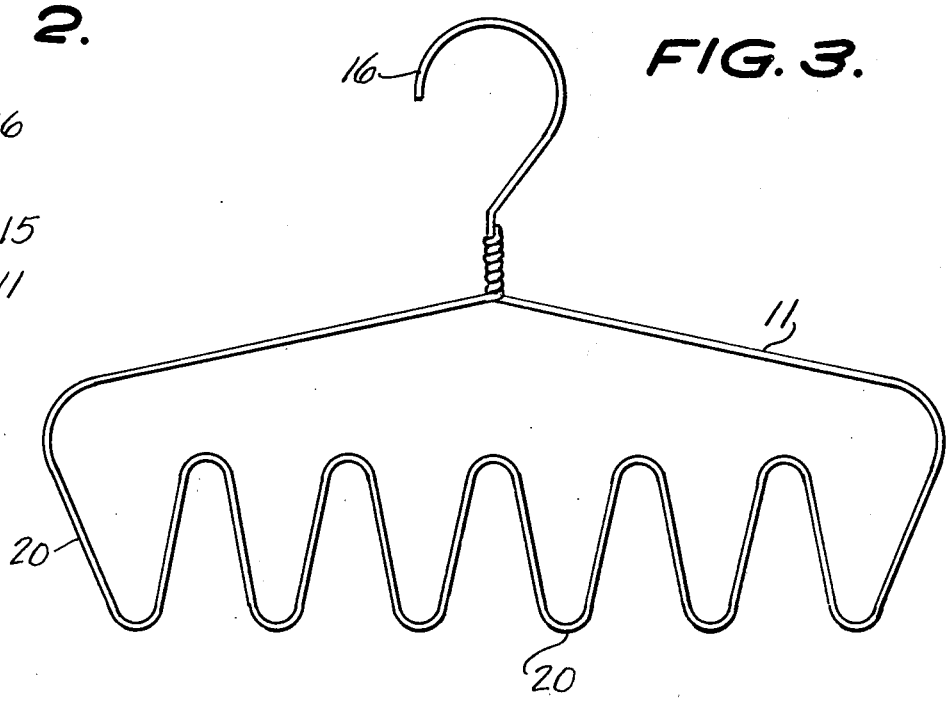
FIG. 3 is a side elevation of another modification of the invention.

In the modification illustrated in FIG. 3 the entire structure including the convolutions for holding the ties as well as the supporting rack are all made from one continuous piece of metal. One end of the metal is twisted into a half circle to form a means for support while the other end is wound around the vertical portion of the supporting end to make one continuous member.

In the use and operation of the invention the curved end 16 of the hanger 10 is placed upon some support so that the plurality of convolutions 20 hang in a vertical plane and then a number of pre-tied neckties are hung in the narrow portions of the convolutions for a display purpose. By its natural formation a pre-tied tie has a narrow portion where the knot is formed and the tapering slot of the convolution 20 is made slightly smaller than this knot so that it will hold the tie in place for either storage or display purposes.

Having thus described the preferred embodiment of the invention it should be understood that numerous structural modifications and adaptations may be resorted to without departing from the spirit of the invention.

What is claimed is:

1. A pre-tied necktie holder comprising a horizontal member of two spaced apart parallel bars, blocks joining the ends of the two bars, a horizontal hole through the center of each block parallel with and below the spaced apart bars, a member pivotally suspended from the horizontal member by attachment to the bars with the outer ends of the member passing through the horizontal holes in the blocks, a plurality of upwardly opening vertically extending, narrowly tapering, uniform slots in the member, and a support attached to the center of the horizontal member.

2. The pre-tied necktie holder of claim 1 wherein the narrowest portion of the tapering slots is materially smaller than the wider portion.

3. A pre-tied necktie holder of claim 2 further including a curved portion on one end of the support member, and rotatable means on the other end for attachment to the topmost parallel bar of the horizontal member.

* * * * *